US012234581B2

(12) United States Patent
Pacheriwala

(10) Patent No.: US 12,234,581 B2
(45) **Date of Patent: *Feb. 25, 2025**

(54) FABRIC MADE OF MULTI-FILAMENT POLYESTER WARP YARNS OF YARN SIZE OF 75 DENIER OR ABOVE AND CELLULOSE FIBER WEFT YARNS

(71) Applicant: Vishal Pacheriwala, Mumbai (IN)

(72) Inventor: Vishal Pacheriwala, Mumbai (IN)

(73) Assignee: Vishal Pacheriwala, Mumbai (IN)

( * ) Notice: Subject to any disclaimer, the term of this patent is extended or adjusted under 35 U.S.C. 154(b) by 0 days.

This patent is subject to a terminal disclaimer.

(21) Appl. No.: 18/197,523

(22) Filed: May 15, 2023

(65) Prior Publication Data

US 2023/0295847 A1 Sep. 21, 2023

Related U.S. Application Data

(63) Continuation-in-part of application No. 17/536,347, filed on Nov. 29, 2021, now Pat. No. 11,795,588.

(30) Foreign Application Priority Data

Jul. 30, 2021 (IN) ..... 202121034383

(51) Int. Cl.
*D03D 13/00* (2006.01)
*D03D 15/208* (2021.01)
(Continued)

(52) U.S. Cl.
CPC ..... *D03D 15/292* (2021.01); *D03D 13/008* (2013.01); *D03D 15/208* (2021.01);
(Continued)

(58) Field of Classification Search
CPC ..... D10B 2201/02; D10B 2331/04; D10B 2503/06; D10B 2201/04; D10B 2503/062;
(Continued)

(56) References Cited

U.S. PATENT DOCUMENTS 4,100,725 A 7/1978 Magel
4,191,221 A 3/1980 Boyer
(Continued)

FOREIGN PATENT DOCUMENTS

CN 105887283 A 8/2016
WO 2011141156 A1 11/2011
WO 2019220196 A1 11/2019

OTHER PUBLICATIONS

Arshi et al., "Frictional Behavior of PLain Woven Fabrics Constructed from Polyester and Cotton Yams in Different Environmental Conditions", Journal of Engineered Fibers and Fabrics, vol. 7, Issue 2, dated 2012, pp. 99-108.
(Continued)

*Primary Examiner* — Robert H Muromoto, Jr.
(74) *Attorney, Agent, or Firm* — Shumaker, Loop & Kendrick, LLP

(57) ABSTRACT

A fabric weaving method and apparatus is disclosed. The method includes forming a fabric where the warp ends of the fabric are made of multifilament polyester yarns and the weft picks are made of cotton or regenerated cellulose fiber or linen fiber or a combination thereof. The woven textile fabric has 50-160 EPI of multifilament polyester yarns of denier within a range of 75 D-200 D with 7-250 filaments in each polyester yarn, and one or more yarns per dent is setup in the reed apparatus of the warp of the loom apparatus. Further, the woven textile fabric includes of 50-91 picks per inch of cotton or regenerated cellulose fibre or linen fiber or a combination thereof and of 20-50 count (NE). Furthermore, the total cover factor of the woven textile fabric is 10-38, and the warp cover factor is 8-19 and the weft cover factor is 10-19.

20 Claims, 3 Drawing Sheets

(51) Int. Cl.

| | |
|---|---|
| ***D03D 15/283*** | (2021.01) |
| ***D03D 15/292*** | (2021.01) |
| ***D03D 15/47*** | (2021.01) |
| ***D03D 15/54*** | (2021.01) |
| ***D03D 45/00*** | (2006.01) |
| *D03D 15/00* | (2021.01) |

(52) U.S. Cl.
CPC ..... *D03D 15/283* (2021.01); *D03D 15/47* (2021.01); *D03D 15/54* (2021.01); *D03D 45/00* (2013.01); *D10B 2201/02* (2013.01); *D10B 2201/22* (2013.01); *D10B 2331/04* (2013.01)

(58) Field of Classification Search
CPC .. D10B 2505/08; D03D 15/00; D03D 13/008; D03D 1/0017; D03D 1/00; D03D 47/30; D03D 47/3046; D03D 47/3066; D03D 15/0061; D03D 15/0077; D03D 15/0094; D03D 23/00; D03D 2700/0137; D03D 13/004; D03D 25/005; D03D 47/38; A47G 9/0238; Y10T 442/3268; Y10T 428/1362; Y10T 442/30; Y10T 442/322; Y10T 442/3228; Y10T 442/3285
See application file for complete search history.

(56) References Cited

U.S. PATENT DOCUMENTS

| | | | |
|---|---|---|---|
| 4,352,380 | A | 10/1982 | Owen et al. |
| 4,496,619 | A | 1/1985 | Okamoto |
| 4,578,306 | A | 3/1986 | Heiman |
| 4,670,326 | A | 6/1987 | Heiman |
| 5,487,936 | A | 1/1996 | Collier |
| 5,495,874 | A | 3/1996 | Heiman |
| 5,524,841 | A | 6/1996 | Rijk et al. |
| 5,843,542 | A | 12/1998 | Brushafer et al. |
| 7,445,177 | B2 | 11/2008 | Wittmann et al. |
| 8,186,390 | B2 | 5/2012 | Krishnaswamy et al. |
| 9,131,790 | B2 | 9/2015 | Agarwal |
| 9,481,950 | B2 | 11/2016 | Agarwal |
| 9,493,892 | B1 | 11/2016 | Agarwal |
| 9,708,737 | B2 | 7/2017 | Agarwal |
| 10,066,324 | B2 | 9/2018 | Agarwal |
| 10,428,445 | B2 | 10/2019 | Agarwal |
| 10,443,159 | B2 | 10/2019 | Agarwal |
| 10,472,744 | B2 | 11/2019 | Agarwal |
| 10,669,651 | B2 | 6/2020 | Gupta |
| 11,047,072 | B2 | 6/2021 | Pacheriwala |
| 11,795,588 | B2 * | 10/2023 | Pacheriwala ..... D03D 15/47 |
| 2003/0190853 | A1 | 10/2003 | Lovingood |
| 2004/0055660 | A1 | 3/2004 | Heiman |
| 2005/0095939 | A1 | 5/2005 | Heiman |
| 2005/0109418 | A1 | 5/2005 | Liao |
| 2006/0014016 | A1 | 1/2006 | Lardizabal et al. |
| 2006/0180229 | A1 | 8/2006 | Heiman |
| 2007/0014967 | A1 | 1/2007 | Tingle et al. |
| 2007/0202763 | A1 | 8/2007 | Shibaoka et al. |
| 2008/0057813 | A1 | 3/2008 | Tingle et al. |
| 2009/0260707 | A1 | 10/2009 | Aneja et al. |
| 2011/0111666 | A1 | 5/2011 | Kim |
| 2011/0133011 | A1 | 6/2011 | Lee et al. |
| 2012/0009405 | A1 | 1/2012 | Krishnaswamy et al. |
| 2014/0308865 | A1 | 10/2014 | Kumar et al. |
| 2015/0047736 | A1 | 2/2015 | Agarwal |
| 2015/0322597 | A1 | 11/2015 | Agarwal |
| 2016/0177478 | A1 | 6/2016 | Agarwal |
| 2016/0222554 | A1 | 8/2016 | Agarwal |
| 2017/0016153 | A1 | 1/2017 | Agarwal |
| 2017/0175303 | A1 | 6/2017 | Agarwal |
| 2017/0314169 | A1 | 11/2017 | Agarwal |
| 2018/0298529 | A1 | 10/2018 | Jhonjhunwala |
| 2018/0347078 | A1 | 12/2018 | Goenka et al. |
| 2018/0371650 | A1 | 12/2018 | Agarwal |
| 2019/0323152 | A1 | 10/2019 | Ranganathan |
| 2020/0032432 | A1 | 1/2020 | Agarwal |
| 2023/0033575 | A1 | 2/2023 | Pacheriwala |

OTHER PUBLICATIONS

Apparel-X, DS1600, "Polyester Cotton Yarn Dyed Gabardine Water Repellent Finish", 13 pages, https://www.apparel-x.com/item.php?itemid=1075722, accessed Nov. 29, 2021.

* cited by examiner

FABRIC MADE OF MULTI-FILAMENT POLYESTER WARP YARNS OF YARN SIZE OF 75 DENIER OR ABOVE AND CELLULOSE FIBER WEFT YARNS

CROSS REFERENCE TO RELATED APPLICATIONS AND PRIORITY

This application is Continuation-in-Part of U.S. patent application Ser. No. 17/536,347 filed on Nov. 29, 2021 which claims priority from Indian Application Number: 202121034383 filed on Jul. 30, 2021, the entirety of which is incorporated herein by a reference.

TECHNICAL FIELD

The present disclosure described herein, in general, relates to textiles, and more particularly, relates to a woven textile fabric, a weaving apparatus for weaving a textile fabric, and a method for weaving the textile fabric which is durable, wrinkle-free, high-strength, soft and affordable.

BACKGROUND

Any fabric, for example, apparel or home textile is desirable depending upon the characteristics it possesses. For example, one of the important characteristics is the softness and/or luxurious feel the fabric can provide to the wearer wearing the fabric. Another characteristic may be the long-lasting ability of the fabric that can withstand to different atmospheric and washing conditions with respect to piling, tearing, shrinkage, wrinkle resistance, dust resistance, seam strength, and overall appearance. In the present scenario, cotton fabric is the most preferred choice for weaving the fabrics. However, cotton fabrics do not take care of most of the above features mentioned. Although cotton fabrics have a smooth feel, however, they cannot correct all the above attributes mentioned.

In order to overcome the aforementioned problems, a fabric weaved with a mix of cotton and polyester of different specifications has been proposed in the past. However, there are various limitations faced by traditional fabrics weaved with a mix of cotton and polyester of different specifications. The existing fabric is weak, and suffers from various kind of shrinkage issue as two different types of yarn quality is used which have different shrinkage ratio. Additionally, the softness of these fabrics available in the market is limited. Above all, most of these fabrics have cotton yarns in the warp and polyester yarns in the weft. However, such a weaving method is not economical and results in huge costs. This is because the cotton warps are not strong enough to bear the abrasion caused in the warp portion of the weaving apparatus during weaving. Further, due to the use of cotton warps in the warp section, a process called sizing is required during warping contributing to an additional sizing cost. Furthermore, in the existing methods, warps and wefts yarns are separately dyed before the weaving of fabric (for chambray effect) thereby leading to an increase in weaving time and cost.

Thus, there is a long-felt need for an improved and cost-effective weaving method and a weaving apparatus for producing a textile fabric that is durable, wrinkle-free, high-strength, soft, and affordable.

SUMMARY

This summary is provided to introduce aspects related to a woven fabric made of cotton yarn or a cellulose fiber yarn or a linen fiber or a combination thereof (In this context, the combination means cotton fiber, cellulose fiber yarn, or linen fiber) and a polyester, a weaving apparatus for weaving the said fabric and a weaving method thereof and are further described below in the detailed description. This summary is not intended to identify essential features of the subject matter nor intended for use in determining or limiting the scope of the subject matter.

In one embodiment, a woven textile fabric is disclosed herein. The woven textile may comprise multi-filament polyester yarns within a predefined range of 50 to 160 ends per inch in the warp. In an embodiment, one or more warp yarns per dent may be setup in the reed apparatus of the warp of the loom apparatus. In an embodiment, the multi-filament polyester yarns may have a denier within a predefined range of 75 to 200, and wherein each multifilament polyester yarn may have from 7-200 filaments. The woven textile may further comprise 50 to 91 picks per inch in the weft, wherein each pick in the weft is made of cotton or regenerated cellulose fiber or a linen fiber or a combination thereof. In an embodiment, the total cover factor of the fabric may be within a predefined range of 10 to 38, and wherein the warp cover factor may be within a predefined range of 8-19, and wherein the weft cover factor may be within a predefined range of 10-19.

In another embodiment, a textile fabric weaving apparatus is disclosed herein. The textile fabric weaving apparatus may comprise a loom apparatus, wherein the loom apparatus further comprises a pick insertion apparatus and a warp shed. The loom apparatus may be configured to form multi-filament polyester yarns within a predefined range of 50 to 160 ends per inch in the warp. In an embodiment, one or more warp yarns per dent may be setup in the reed apparatus of the warp of the loom apparatus. In an embodiment, the multi-filament polyester yarns may have a denier within a predefined range of 75 to 200, and wherein each multifilament polyester yarn may have from 7-200 filaments. Further, the loom apparatus may be configured to form 50 to 91 picks per inch in the weft, wherein each pick in the weft is made of cotton or regenerated cellulose fiber or a linen fiber or a combination thereof. In an embodiment, the total cover factor of the fabric may be within a predefined range of 10 to 38, and wherein the warp cover factor may be within a predefined range of 8-19, and wherein the weft cover factor may be within a predefined range of 10-19.

In yet another embodiment, a method for weaving a textile fabric is disclosed herein. The method may comprise a step of forming multi-filament polyester yarns within a predefined range of 50 to 160 ends per inch in the warp. In an embodiment, one or more warp yarns per dent may be setup in the reed apparatus of the warp of the loom apparatus. In an embodiment, the multi-filament polyester yarns may have a denier within a predefined range of 75 to 200, and wherein each multifilament polyester yarn may have from 7-200 filaments. Further, the method may comprise a step of forming 50 to 91 picks per inch in the weft, wherein each pick in the weft is made of cotton or regenerated cellulose fiber or a linen fiber or a combination thereof. In an embodiment, the total cover factor of the fabric may be within a predefined range of 10 to 38, and wherein the warp cover factor may be within a predefined range of 8-19, and wherein the weft cover factor may be within a predefined range of 10-19.

In one embodiment, the weight or gsm of the woven textile fabric may be within a predefined range of 80 to 160 grams per square meter. In another embodiment, the width of the fabric may be within a predefined range of 40 inches to 140 inches. In yet another embodiment, the warp tear strength of the woven fabric may be within a predefined range of 2 lbf to 10 lbf. In yet another embodiment, the weft tear strength of woven fabric may be within a predefined range of 1 lbf to 10 lbf. In yet another embodiment, the tensile strength of the warp may be within a predefined range of 20 lbf to 120 lbf. In yet another embodiment, the tensile strength of the weft may be within a predefined range of 10 lbf to 60 lbf. In yet another embodiment, the shore hardness of the yarn used may be within a predefined range of 10 to 75. In still another embodiment, the winding angle of the yarn may be within a predefined range of 15-90. In yet another embodiment, the seam strength/slippage may be within a predefined range of 9 lbf to 50 lbf.

In one aspect of the present disclosure, the yarn count of the cotton, or the regenerated cellulose fiber, or the linen fiber, or the combination thereof may be within a predefined range of 20-50 (Ne) count.

In another aspect of the present disclosure, the woven textile may be made of recycled yarns, wherein either of the weft yarns or warp yarns or both may be recycled yarns made from waste/used items.

In another aspect of the present disclosure, the warp to fill ratio of the fabric may be within predefined range of 3:1 and 1:1.3.

In yet another aspect of the present disclosure, the cellulose fiber constitutes at least 50% of the total composition in the woven textile fabric.

In yet another aspect of the present disclosure, the total thread count of the woven textile fabric may be within a predefined range of 100 to 250 per inch.

In yet another aspect of the present disclosure, the woven textile fabric may be weaved in form of a plain weave or a twill weave.

In yet another aspect of the present disclosure, either of the warps or wefts may be dyed after the weaving of the fabric in order to obtain chambray effect or a special design effect.

In yet another aspect of the present disclosure, either of the warps or wefts may be dyed with different shades after the weaving of the fabric to give a unique texture effect in the fabric.

In yet another aspect of the present disclosure, the weft yarn picks are woven into the fabric using a single pick insertion event of a pick insertion apparatus of the loom apparatus.

In yet another aspect of the present disclosure, the pick insertion apparatus of a loom apparatus may include an air jet insertion apparatus or a rapier pick insertion apparatus or a sulzer pick insertion apparatus.

In yet another aspect of the disclosure, the speed of the textile fabric weaving apparatus may be set within a predefined range of 150 RPM to 1000 RPM.

In yet another aspect of the present disclosure, the multifilament polyester yarns are setup in the reed apparatus of the loom apparatus in warp section of the loom apparatus.

In still another aspect of the present disclosure, a method of weaving a fabric includes determining the cover factor of the fabric. The cover factor is a mathematical formula to determine the optimum cover factor. The cover factor determines the gap between yarns and whether the weave is balanced. The total cover factor of the fabric may be within a predefined range of 10 to 38. Further, the warp cover factor may be within a predefined range of 8-19 and the weft cover factor may be within a predefined range of 10-19.

In one embodiment, the woven fabric may have multifilament polyester in the warp yarns of denier between 75-200 denier, wherein the multifilament polyester yarn may have multifilaments ranging from 7-250. Further, each multifilament polyester yarn may have at least 50% number of filaments with respect to the denier size of the yarn in terms of numerical value. For example, 80 denier yarn may have at least 40 filaments per yarn or a 150 denier multifilament polyester yarn may have at least 75 number of filaments per yarn. This mathematical formula was derived to ascertain and balance two primary results in a woven fabric i.e. the softness of the fabric (softness being the primary goal as that is the way a fabric quality is determined) and the cost of the fabric and the shrinkage of the fabric after the process. The higher number of filaments means softer fabric however it also means higher cost and shrinkage. With the trials, it was concluded that the minimum number of filaments in the multi-filament polyester yarn should be at least be 50% of the yarn size (i.e. numerical value of denier of the yarn) in numerical terms.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to refer to like features and components.

FIG. 2(*b*) depicts the setting of warp yarns using reed apparatus (203) of the loom apparatus, in accordance with an embodiment of the present disclosure.

DETAILED DESCRIPTION

Figure 1:
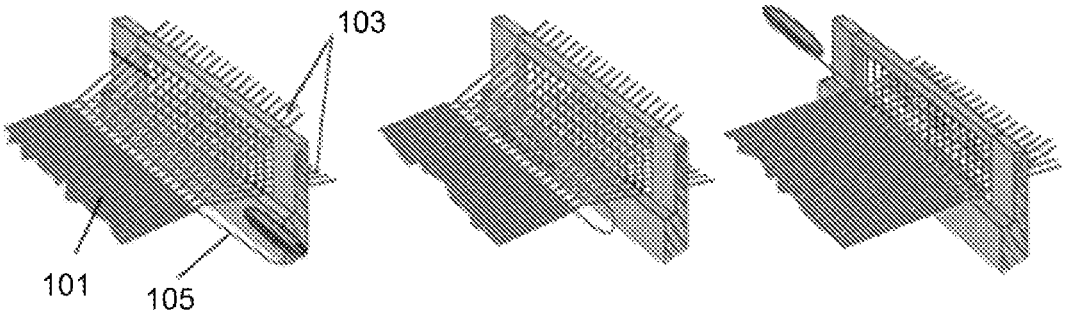
FIGS. 1 (*a*), 1 (*b*), and 1 (*c*) illustrate different stages of a weaving process implemented using a weaving apparatus, in accordance with an embodiment of the present disclosure.

Some embodiments of this disclosure, illustrating all its features, will now be discussed in detail. The words "comprising," "having," "containing," and "including," and other forms thereof, are intended to be equivalent in meaning and be open-ended in that an item or items following any one of these words is not meant to be an exhaustive listing of such item or items, or meant to be limited to only the listed item or items.

It must also be noted that, the singular forms "a," "an," and "the" include plural references unless the context clearly dictates otherwise. Although any methods similar or equivalent to those described herein can be used in the practice or testing of embodiments of the present disclosure, the exemplary methods are now described. The disclosed embodiments are merely exemplary of the disclosure, which may be embodied in various forms.

It must be noted herein that ranges mentioned in various embodiments of the present disclosure is not limited to specified ranges therein and should be construed to also cover any range (not specifically mentioned herein) where endpoints (i.e. minimum value, maximum value) include any value that lies between any specified range mentioned herein.

Various modifications to the embodiment will be readily apparent to those skilled in the art and the generic principles herein may be applied to other embodiments. However, one of ordinary skill in the art will readily recognize that the present disclosure is not intended to be limited to the embodiments illustrated, but is to be accorded the widest scope consistent with the principles and features described herein.

Definitions

Terms used throughout this application are to be construed with ordinary and typical meaning to those of ordinary skill in the art. However, Applicants desire that the following terms be given the particular definition as defined below:

The terms ENDS PER INCH or "Ends per Inch" is the popular word in the garments & textile industry. The number of yarns in the warp direction is measured by ENDS PER INCH. Normally, ends per Inch are the number of warp threads. It represents the vertical thread of the fabric. It is called the warp yarn.

The term "warp" is the set of lengthwise yarns through which the weft is woven. Each individual warp thread in a fabric is called a warp end. Warp means "that which is thrown across".

The term "reed" means a comb-like device on a loom that separates the warp yarns and also beats each succeeding filling yarn against those already woven. The space between two adjacent wires of the reed is called a dent. The fineness of the reed is calculated by the number of dents to the inch. The more dents to the inch, the finer the reed.

The term "picking" means inserting weft threads across the warp through during weaving. Picking is the second primary motion in weaving. A single pick may contain 1-24 yarns. If the number of strands per pick is more than one, it is known as multi-strand yarn/plied yarn.

The term "Airjet" or "Airjet loom" or "Airjet loom apparatus" is a shuttleless loom capable of very high speeds that use an air jet to propel the filling yarn through the shed.

The term "Rapier" or "Rapier loom" or "Rapier loom apparatus" is a shuttleless weaving loom in which the filling yarn is carried through the shed of warp yarns to the other side of the loom by fingerlike carriers called rapiers.

The term "plain weave", also called "Tabby weave", is the simplest and most common of the three basic textile weaves. The plain weave is made by passing each filling yarn over and under each warp yarn, with each row alternating, producing a high number of intersections.

The term "count" or "yarn count" refers to the thickness of yarn and is determined by its mass per unit length. It is usually measured by the number of grams per one kilometer of yarn, a unit of measure called "Tex". However, the spinning industry tends to use English cotton count, which is determined by the number of yarn hanks (each 840 yards long) per pound of yarn, and is notated "Ne".

The term "denier" is a direct-management type, employed internationally to measure the size of silk and man-made filaments and yarns, and derived from an earlier system for measuring silk filaments (based on the weight in drams of 1,000 yards). The number denier indicates the weight in grams of 9,000 meters of filament or filament yarn. For example, if 9,000 meters of yarn weighs 15 grams, it is a 15-denier yarn; if 9,000 meters of yarn weighs 100 grams, it is a 100-denier yarn and much coarser than the 15-denier yarn. Thus, a smaller number indicates a finer yarn.

Regenerated cellulose fiber is a class of materials manufactured by the conversion of natural cellulose to a soluble cellulosic derivative and subsequent regeneration, typically forming either a fiber (via polymer spinning) or a film (via polymer casting).

While aspects of the described woven fabric made of polyester warp yarns and cotton or cellulose fiber weft yarns or liner fiber yarns or a combination thereof (In this context, the combination means cotton fiber, cellulose fiber blended yarn, and linen fiber) and a polyester warp yarns may be implemented in any number of different systems, environments, and/or configurations, the embodiments may be described in the context of the following exemplary system.

In accordance with an embodiment of the present disclosure, a method and apparatus for weaving a woven textile fabric are described herein. The woven textile may comprise multi-filament polyester yarns within a predefined range of 50 to 160 ends per inch in the warp. In one exemplary embodiment, the woven textile may comprise multi-filament polyester yarns within a predefined range of 60 to 160 ends per inch in the warp. In an embodiment, one or more warp yarns per dent may be setup in the reed apparatus of the warp of the loom apparatus. In one exemplary embodiment, one to four warp yarns per dent may be set up in the reed apparatus of the warp of the loom apparatus. In an embodiment, the multi-filament polyester yarns may have a denier within a predefined range of 75 to 200, and wherein each multifilament polyester yarn may have from 7-200 filaments. In one exemplary embodiment, the woven fabric may have a thread count per inch within a predefined range of 100 to 250. In one embodiment, the woven textile may further comprise 50 to 91 picks per inch in the weft, wherein each pick in the weft is made of cotton or regenerated cellulose fiber or a combination thereof. In an exemplary embodiment, the woven textile may comprise 55 to 85 picks per inch in the weft. In an embodiment, the total cover factor of the fabric may be within a predefined range of 10 to 38, wherein the warp cover factor may be within a predefined range of 8-19, and the weft cover factor may be within a predefined range of 10-19.

It must be noted herein that the fabric made using polyester yarns in the warp provides enhanced attributes to the fabric such as wrinkle-free, luster, strength, and cost-effectiveness. Further, the weft yarns cotton or regenerated cellulose fiber or a combination of both fibers used in the weft provides breathability, comfort, and enhanced softness. It must be understood that the advantage of a balanced ENDS PER INCH in the warp and that warp yarns made of polyester yarns is the reduction in the overall cost of the fabric. The advantage of polyester yarns in warp is many folds. First, the polyester is the cheapest fiber thus it makes the fabric cheaper and cost-effective. Second, the machine runs faster and efficiently as the polyester yarns are strong to bear the abrasion caused in the warp portion of the weaving during weaving. Third, using polyester yarns in the warp, a process called sizing required during warping is eliminated and thus the sizing cost is saved. Other benefits of the polyester yarns include the capability of dyeing the fabric with two different colors thereby giving a good design effect/heather/chambray effect explained in detail subsequent paragraphs.

In accordance with embodiments of the present disclosure, the fabric is weaved in such a way that its strength is enhanced. The enhanced strength helps the fabric to go through a mechanical finishing process known as peaching/napping/liza which in turn enhances the fabric feel and desirability. The existing cotton weft and polyester warp cross weave fabric may not be able to go through the above mechanical finishing process as the fabric may not be able to withstand the mechanical abrasion during the mechanical finishing process. Thus, this may result in the existing fabric tearing or pill drastically, if it undergoes the above mechanical finishing process.

In accordance with an embodiment of the present disclosure, the fabric is weaved in such a way that embossing of a design on the woven fabric using a calendar heat press machine is possible. It must be noted herein that embossing makes the fabric look like a jacquard weaved fabric. However, the embossing technology in the woven fabrics is primarily possible in 100% polyester fabric only, but due to the unique construction and weave of the fabric of the present disclosure makes it possible to emboss designs on cotton rich (cotton greater than 50%) woven fabric using calendar heat press machine.

In accordance with an embodiment of the present disclosure, since the polyester uses different dyes and colors to fix color on polyester yarn, while cellulose yarns use a different process to dye and fix the color of cotton yarns, the inventor of the present application discovered that one can dye two different colors for different yarns while processing the fabric, or dye on only one type of yarn which would give a chambray/heather effect or a design effect that have two different colors. In the existing art, one has to first dye the yarns and then weave the colored yarns to get the above chambray/heather effect or a design effect. However, due to the above feature in the present invention, one can dye the fabric instead of the yarn thus saving on the cost of dyeing yarns. Thus, according to the present invention, one can give different effects to the fabric using two dye colors or just dyeing warp side or weft side of the fabric in order to obtain a nice heather/chambray/design. This is made possible due to the unique nature of dye fixation in different fibers.

Now, referring to FIGS. 1 (*a*), 1 (*b*) and 1 (*c*), different stages of a weaving process implemented using a weaving apparatus are illustrated, in accordance with an embodiment of the present disclosure.

As shown in FIG. 1 (*a*), a woven fabric 101 is illustrated. In one embodiment, the woven fabric may be a woven fabric textile marketed and sold by the applicant herein by the trade name "Lux Du Cotton/suave cotton edition/mystique/oxford milange". As shown, the woven fabric is usually longer in one direction than the other. The lengthwise threads are called the warps (103), while the other threads, which are combined with the warps 103 and lie widthwise, are called the wefts (105).

Typically, in the all known methods of weaving, before a length of the weft is inserted in the warp, the warp is separated, over a short length extending from the fabric already formed, into two sheets. The process is called shedding (as indicated in FIG. 1 (*a*)) and the space between the sheets is referred to as the shed. A pick of weft is then laid between the two sheets of warp, in the operation known as picking (as indicated in FIG. 1 (*b*)). A new shed is then formed in accordance with the desired weave structure, with some or all of the ends in each sheet moving over to the position previously occupied by the other sheet. In this way, the weft is clasped between two layers of warp.

Since it is not possible to lay the weft close to the junction of the warp and the cloth already woven, a further operation called beating in, or beating up (as indicated in FIG. 1 (*c*)), is necessary to push the pick to the desired distance away from the last one inserted previously. Although beating usually takes place while the shed is changing, it is normally completed before the new shed is fully formed.

The sequence of primary operations in one weaving cycle is thus shedding (FIG. 1 (*a*)), picking (FIG. 1 (*b*)), and beating (FIG. 1 (*c*)). At the end of the cycle, the geometrical relation of the pick to the warp is the same as it would have been if the pick had been threaded through the spaces between alternate ends, first from one side of the fabric and then from the other, as in darning. This is the reason the weaving process is considered an interlacing method.

In accordance with embodiments of the present disclosure, a woven fabric with enhanced durability, softness, wrinkle resistance, strength, and low cost is proposed. The woven fabric comprises from 50 to 160 ends per inch polyester warp yarns and from 50 to 91 picks per inch in the weft. In another aspect, the weft yarns may be made of cotton yarn or regenerated cellulose yarn or linen fiber yarn or a combination thereof. In yet another aspect, the yarn count on the weft may be within a range of 20-50 count (Ne). In other words, a fabric made with a combination of cotton, polyester warp yarns and regenerated cellulose fiber is proposed herein, wherein cotton or a regenerated cellulose fiber or linen fiber or a combination thereof may be used as weft yarns and the polyester may be used as warp yarns.

In accordance with embodiments of the present disclosure, the weaving method of the fabric may include cotton yarn or regenerated cellulose yarn or linen fiber yarn or a combination thereof of count within a range of 20-50 (NE) in the weft, wherein the ENDS PER INCH of the warp (103) is within a range of 50-160. In the weft insertion step, courser cotton yarns of 20-50 count (NE) are inserted in the loom apparatus of the weaving apparatus, the apparatus may include an air jet or rapier or Sulzer loom. In alternative embodiments, the looming apparatus such as a bullet, magnetic levitation bullet, water jet, air jet and the like may also be employed.

In one embodiment, the picks are woven into the textile fabric (e.g., fabric 101) in groups of cotton weft yarns (105) running in a parallel form to one another. In one embodiment, the cotton weft yarns (105) are wound adjacent to one another to enable the simultaneous inserting of the multi-filament polyester weft yarns during a single pick insertion event of a pick insertion apparatus of a loom apparatus (e.g. air jet or rapier or sulzer).

In one embodiment, the woven textile fabric (e.g., fabric 101) may be made of cotton, regenerated cellulose fiber or a combination thereof and multi-filament polyester yarns (103). In one embodiment, the woven textile fabric (e.g., fabric 101) may have a total thread count from 100 to 250. In one embodiment, the yarn count on the weft is within a predefined range of 20-50 (Ne) count.

In another embodiment, a method of a woven textile fabric (e.g., fabric 101) includes forming 100 to 250 threads per inch fine textile fabric. The method forms the woven textile having from 50 to 160 ends per inch warp yarns and the warp yarn count being 75 D-200 D, wherein 1-4 warp yarn per dent may be setup in the reed apparatus of the warp (103) of the loom apparatus and from 50 to 91 picks per inch in the weft wherein the weft yarns are made of cotton or other cellulose fibers.

Figure 2:
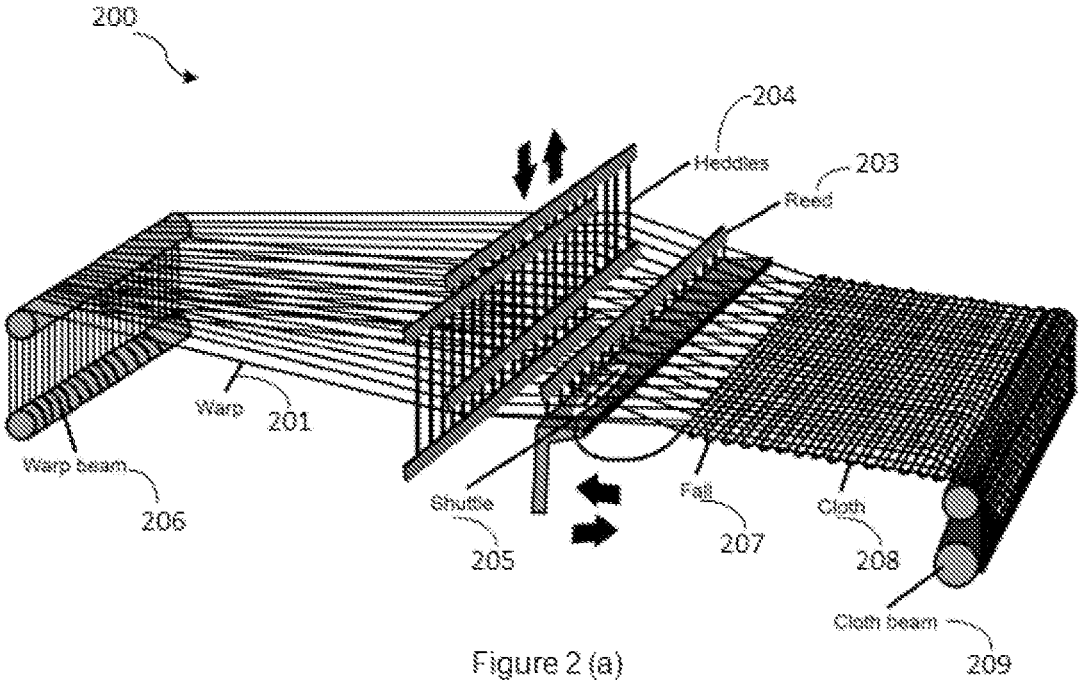
FIG. 2(*a*) illustrates a loom apparatus 200, in accordance with an embodiment of the present disclosure.
Figure 2:
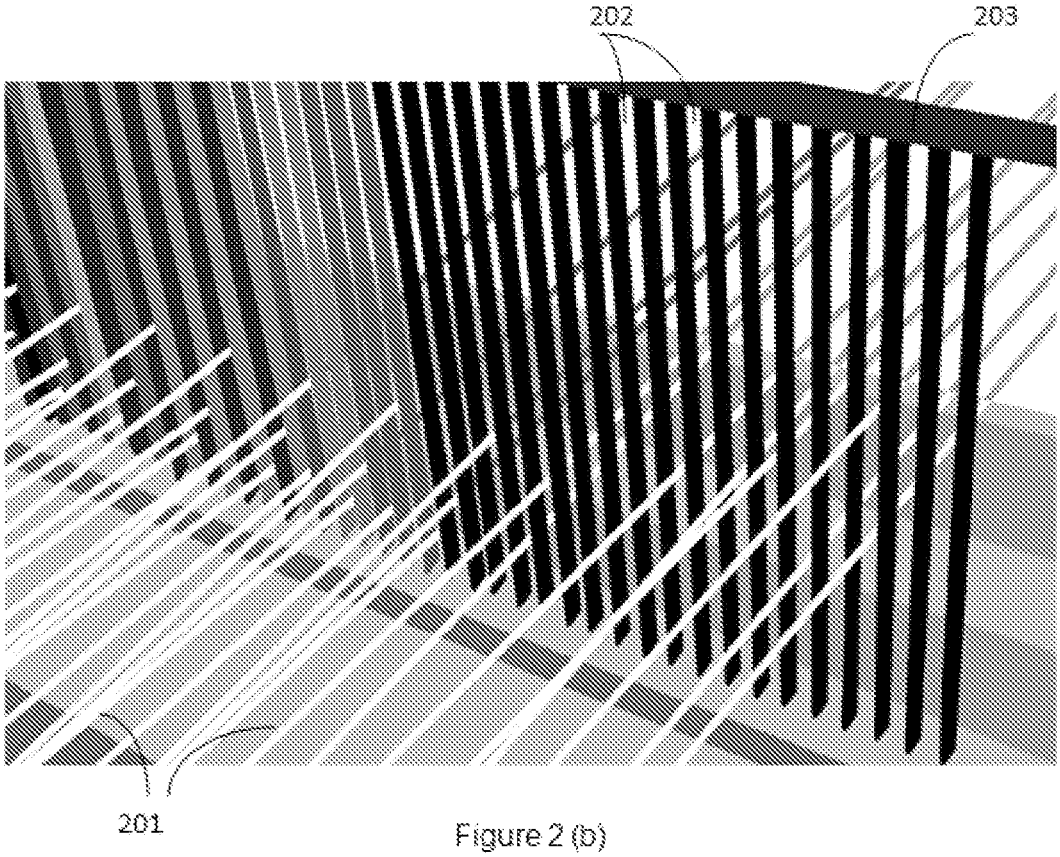

FIG. 2(*a*) illustrates a loom apparatus 200, in accordance with an embodiment of the present disclosure. As shown the loom apparatus (200) comprises the reed apparatus (203) collectively facilitating the process of forming a cloth (208) to obtain cloth beam (209). A warp (201) from a warp beam (206) is set up per dent in the reed apparatus (203) of the loom apparatus 200. FIG. 2(*b*) depicts the setting of warp yarns (201) using reed apparatus (203) of the loom apparatus (200), in accordance with an embodiment of the present disclosure. As shown in FIG. 2(*b*), a gap between two strands (indicated in dark) represents a dent (202) through which a warp yarn (indicated in white color) is set up in the reed apparatus (comb-like apparatus). The functions of the components Heddles (204), shuttle (205), and fall (207) are as per the teachings known in the art and hence have not been explained for the sake of brevity.

Some embodiments of the present disclosure enable in forming a woven fabric with long-lasting durability.

Some embodiments of the present disclosure enable in forming a woven fabric having a courser count yarn in warps of 75 D-200 D, wherein the courser count yarn has a higher surface area and is economical than finer yarns. The coarser count yarn increases the surface area covered by the yarn in the fabric. A higher surface area is provided to the warp yarn. Additionally, coarser count is stronger to bear the abrasion of the warp portion during weaving thus allowing to increase efficiency during weaving of fabric and thereby minimizing the cost.

Figure 3A:
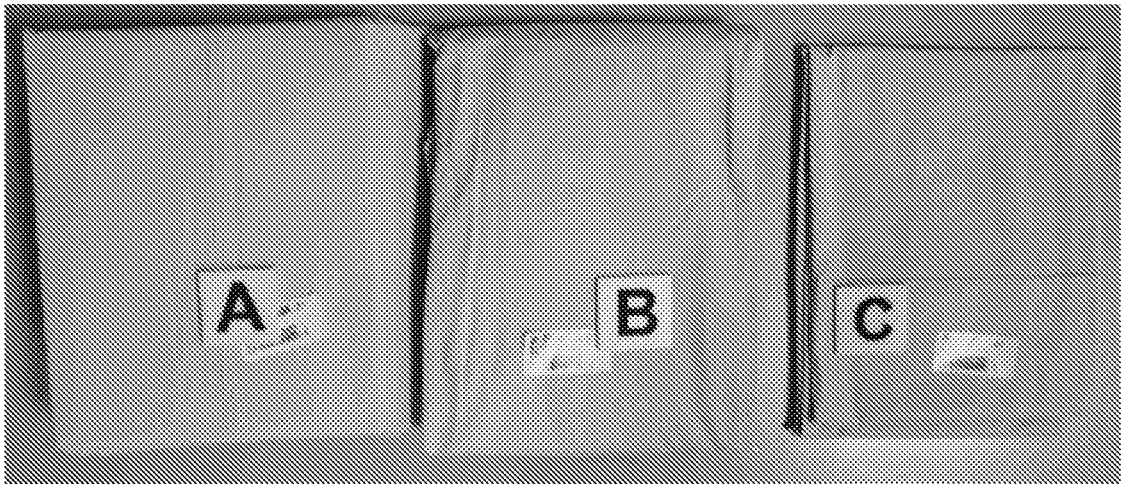
FIGS. 3(*a*) and 3(*b*) depict specimen/samples of the woven textile fabric tested in accordance with various global standards.

In one exemplary embodiment, three different samples/specimens (hereafter referred to as Sample A, Sample B, and Sample C as shown in FIG. 3*a*) of the woven textile fabric of the present invention were tested in accordance with testing standards prescribed in the textile domain. The results of the tests conducted are summarized below:

1. Fiber Identification/Composition (AATCC 20/20A) for Sample A

Length Cotton
Width Polyester
FIBER COMPOSITION (ON FABRIC BASIS): Cotton: 59.5%
Polyester: 40.5%
REMARK:
AATCC: Moisture regain based on ASTM D 1909:2012
Polyester 0.4%
Cotton: 8.0%

2. Dimension Stability to Washing-Gmt—3 Wash (AATCC 150 (3 Wash)

1 (II) A (ii) MACHINE WASH AT 85° F. NORMAL CYCLE FOLLOWED BY TUMBLE DRY MEDIUM.

| | Original (Inch) | After 3-Rd Wash (Inch) | Dimensional Change (%) | Requirement |
|---|---|---|---|---|
| | | Sample A | | |
| Length | 102.1 | 101.0 | −1.1 | 4% Max |
| Width | 90.8 | 90.0 | −0.9 | |
| | | Sample B | | |
| Length | 81.8 | 80.5 | −0.4 | 4% Max |
| Width | 61.5 | 60.6 | −1.5 | |
| Height | 15.0 | 14.8 | −1.4 | |
| | | Sample C | | |
| Length | 30.5 | 30.2 | −1.0 | 4% Max |
| Width | 20.2 | 19.7 | −2.5 | |

Remark: [+] means Extension and [−] means Shrinkage

3. Color Fastness to Crocking (AATCC 8): For Sample A

| A | | |
|---|---|---|
| | Observed Value | Requirement |
| Dry | 4.5 | 3.5 |
| Wet | 4.5 | 2.5 |

4. Color Fastness to Non-Chlorine Bleach (AATCC TS 001 (MOD)): For Sample A

| | Observed Value |
|---|---|
| Liquid Chlorox 2 | 4.0 |
| Solid Chlorox 2 | 3.5 |

5. Color Fastness to Light [10 Afu] (AATCC 16 (10 Afu))

| A | | |
|---|---|---|
| | Observed Value | Requirement |
| Color Change (10 Afu) | 4.0 | 3.5 |

6. Construction (ASTM D3775-12): For Sample A

| | Observed Value (Per Inch) |
|---|---|
| Length | 67 |
| Width | 68 |

7. Fabric Weight (ASTM D3776): For Sample A

| | Observed Value |
|---|---|
| Gm./sq. Mtr | 132.17 |
| Oz./sq. Mtr | 3.9 |

8. Tearing Strength (ASTM D1424): For Sample A

| | Observed Value | Requirement |
|---|---|---|
| Length | 2.10 lb | 1.3 lb |
| Width | 8.10 lb | 1.3 lb |

9. Tensile Strength (ASTM D5034): For Sample A

| | Observed Value | Requirement |
|---|---|---|
| Length | 34.2lb | 20 lb |
| Width | 108.7lb | 20 lb |

10. Yarn Count (ASTM D1059): For Sample A

| | Observed Value |
|---|---|
| Length | 21.0 Ne |
| Width | 161.2 D |

11. Color Fastness to Home Laundering: [3 Wash] AATCC 150 (3 Wash)

1 (II) A (ii) MACHINE WASH AT 85° F. NORMAL CYCLE FOLLOWED BY TUMBLE DRY MEDIUM.

After 1St Wash

| Parameter | | Sample A | Sample B | Sample C | Requirement |
|---|---|---|---|---|---|
| Color Change | | 3.5 | 3.5 | 3.5 | — |
| Color Staining | Acetate | 4.5 | 4.5 | 4.5 | 3.0 |
| | Cotton | 4.5 | 4.5 | 4.5 | |
| | Nylon | 4.5 | 4.5 | 4.5 | |

-continued

| Parameter | Sample A | Sample B | Sample C | Requirement |
|---|---|---|---|---|
| Polyester | 4.5 | 4.5 | 4.5 | |
| Acrylic | 4.5 | 4.5 | 4.5 | |
| Wool | 4.5 | 4.5 | 4.5 | |

12. Seam Slippage/Strength (ASTM D1683):
For Sample B:

| | Slippage | | Strength | |
|---|---|---|---|---|
| Corner Seam | Observed Value | Requirement | Observed Value | Requirement |
| | * | Min 15 lb | 26.3 lb [STB] | Min 15 lb |

For Sample C:

| | Slippage | | Strength | |
|---|---|---|---|---|
| Side Seam | Observed Value | Requirement | Observed Value | Requirement |
| | | Min 15 lb | 31.3 lb [STB] | Min 15 lb |

REMARK:
STB = Sewing Thread Broken.
* = The seam opening was less than 0.25 inches (¼ inches) though the ultimate seam strength was found as stated.

Figure 3B:
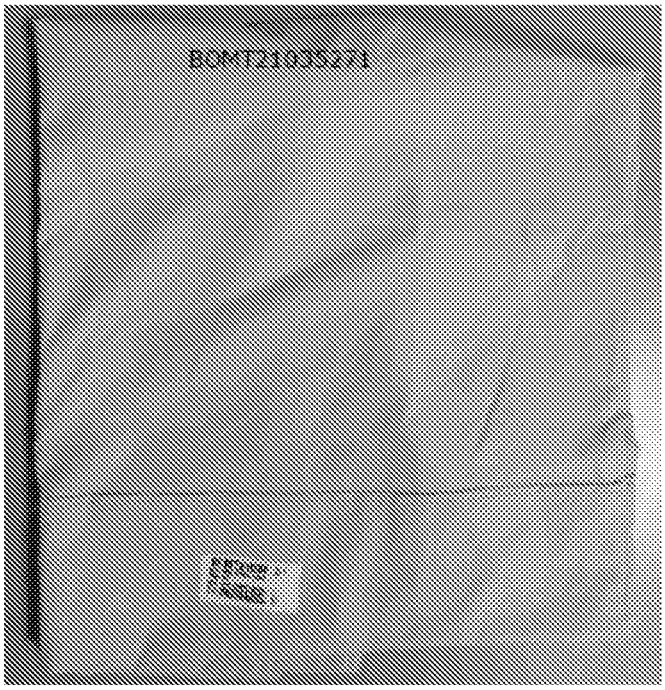

In another exemplary embodiment, a sample/specimen (as shown in FIG. 3*b*) of the woven textile fabric containing 60% cotton and 40% Polyester was tested for determining the number of filaments, the result of which is summarized below:

1. Number of Filaments:

| | Observed Value |
|---|---|
| Length | 130 |
| Width | * |

Remark:
*: Due to spun structure of the yarn, the number of filaments cannot be performed.

Some embodiments of the present disclosure enable in forming a woven fabric having a cotton fiber yarn or regenerated cellulose fiber yarn or a combination thereof in the warp, wherein the said fiber yarn is softer, breathable, comfortable, and drapes well.

Some embodiments of the present disclosure enable in forming a woven fabric having courser count yarn on the weft and the courser polyester yarns (in denier) on the warp which makes the fabric naturally soft. The warp yarn is courser thus covers the higher surface area, additionally, the fabric looks fuller and rich due to optimum cover factor and using coarser yarns in warp and weft.

Although implementations for apparatus(s) and method(s) of forming a woven fabric textile with high thread count, enhanced durability, softness, wrinkle resistance, strength, and low cost have been described in language specific to structural features and/or methods, it is to be understood that the implementations and/or embodiments are not necessarily limited to the specific features or methods described. Rather, the specific features and methods are disclosed as examples of implementations for forming a woven fabric textile with enhanced durability, ultimate softness, wrinkle resistance, light in weight and ultra-low-cost.

What is claimed is:

1. A woven textile fabric, comprising:
multi-filament polyester yarns within a predefined range of 50 to 160 ends per inch in the warp; and
50 to 91 picks per inch in the weft, wherein each pick in the weft is made of cotton or regenerated cellulose fiber or linen fiber or a combination thereof;
wherein one or more warp yarns per dent is setup in the reed apparatus of the warp of the loom apparatus,
wherein the multi-filament polyester yarns have a denier within a predefined range of 75 to 200, and wherein each multifilament polyester yarn have filaments ranging from 7-200, and
wherein the total cover factor of the fabric is within a predefined range of 10 to 38, and wherein the warp cover factor is within a predefined range of 8-19, and wherein the weft cover factor is within a predefined range of 10-19.

2. The woven textile fabric of claim 1, wherein the yarn count of the cotton, or the regenerated cellulose fiber warp, or the linen fiber, or the combination thereof is within a predefined range of 20-50 (Ne) count.

3. The woven textile fabric of claim 1, wherein the warp to fill ratio of the fabric is within a predefined range of 3:1 and 1:1.3.

4. The woven textile fabric of claim 1, wherein the total thread count of the woven textile fabric is within a predefined range of 100 to 250 per inch.

5. The woven textile fabric of claim 1, wherein the cotton or regenerated cellulose fiber or linen fiber or a combination thereof constitutes at least 50% of the total composition in the woven textile fabric, and wherein the fabric is weaved in form of a plain weave or a twill weave.

6. The woven textile fabric of claim 1, wherein the woven textile fabric has:
weight within a predefined range of 80 to 160 grams per square meter;
a woven fabric width within a predefined range of 40 inches to 140 inches;
a warp tear strength of the woven fabric is within a predefined range of 2 lbf to 10 lbf,
a weft tear strength of woven fabric may be within a predefined range of 1 lbf to 10 lbf;
a tensile strength of the warp is within a predefined range of 20 lbf to 120 lbf; and
a tensile strength of the weft may is within a predefined range of 10 lbf to 60 lbf.

7. The woven textile fabric of claim 1, wherein
either of the warp yarns or weft yarns are dyed after weaving of the fabric in order to obtain chambray effect or a special design effect in the fabric, or
either of the weft yarns or the warp yarns are dyed with different shades after weaving to give a unique texture look, or
either of the warp yarns or weft yarns are single color dyed from light to medium color range after weaving of the fabric to save cost, while the whole fabric effect looks like it is dyed in one single color also known as single dyed fabrics or both warp and weft yarns are dyed in the same color in 2 different processes to enhance the depth of the color.

8. The woven textile fabric of claim 1, wherein either of the warp yarns or weft yarns or both are recycled yarns made from waste or used items.

9. The woven textile fabric of claim 1, wherein the multifilament polyester yarn has multifilaments ranging from 7-250, and wherein each multifilament polyester yarn has at least 50% number of filaments with respect to the numerical value of denier size of the yarn.

10. A textile fabric weaving apparatus, comprising:

a loom apparatus, wherein the loom apparatus comprises a pick insertion apparatus and a warp shed, wherein the loom apparatus is configured to:

form multi-filament polyester yarns within a predefined range of 50 to 160 ends per inch in the warp; and form 50 to 91 picks per inch in the weft, wherein each pick in the weft is made of cotton or regenerated cellulose fiber or linen fiber or a combination thereof;

wherein one or more warp yarns per dent is setup in the reed apparatus of the warp of the loom apparatus, wherein the multi-filament polyester yarns have a denier within a predefined range of 75 to 200, and wherein each multifilament polyester yarn have filaments ranging from 7-200, and wherein the total cover factor of the fabric is within a predefined range of 10 to 38, and wherein the warp cover factor is within a predefined range of 8-19, and wherein the weft cover factor is within a predefined range of 10-19.

11. The textile fabric weaving apparatus of claim 10, wherein the loom apparatus is either air jet loom apparatus, a rapier loom apparatus, or Sulzer loom apparatus, water jet apparatus or power loom apparatus and wherein the speed of the textile fabric weaving apparatus is within a predefined range of 150 RPM to 1000 RPM.

12. The textile fabric weaving apparatus of claim 10, wherein the warp to fill ratio of the fabric is within a predefined range of 3:1 and 1:1.3.

13. The textile fabric weaving apparatus of claim 10, wherein the total thread count of the woven textile fabric is within a predefined range of 100 to 250 per inch.

14. The textile fabric weaving apparatus of claim 10, wherein the yarn count of the cotton, or the regenerated cellulose fiber warp, or the linen fiber, or the combination thereof is within a predefined range of 20-50 (Ne) count.

15. The textile fabric weaving apparatus of claim 10, wherein the cotton or regenerated cellulose fiber or linen fiber or a combination thereof constitutes at least 50% of the total composition in the woven textile fabric, wherein the fabric is weaved in form of a plain weave or a twill weave.

16. The textile fabric weaving apparatus of claim 10, wherein the woven textile fabric has:

a weight within a predefined range of 80 to 160 grams per square meter;

a width within a predefined range of 40 inches to 140 inches;

a warp tear strength of the woven fabric is within a predefined range of 2 lbf to 10 lbf;

a weft tear strength of woven fabric may be within a predefined range of 1 lbf to 10 lbf;

a tensile strength of the warp is within a predefined range of 20 lbf to 120 lbf; and a tensile strength of the weft may is within a predefined range of 10 lbf to 60 lbf.

17. The textile fabric weaving apparatus of claim 10, wherein either of the warp yarns or weft yarns are dyed after weaving of the fabric in order to obtain chambray effect or a special design effect in the fabric, or either of the weft yarns or the warp yarns are dyed with different shades after weaving to give a unique texture look.

18. A method of forming woven textile fabric, the method comprising:

forming multi-filament polyester warp yarns within a predefined range of 50 to 160 ends per inch in the warp; and forming 50 to 91 picks per inch in the weft, wherein each pick in the weft is made of cotton or regenerated cellulose fiber or linen fiber or a combination thereof, wherein the yarn count of the cotton, or the regenerated cellulose fiber warp, or the linen fiber, or the combination thereof is within a predefined range of 20-50 (Ne) count;

wherein one or more warp yarns per dent is setup in the reed apparatus of the warp of the loom apparatus, wherein the multi-filament polyester yarns have a denier within a predefined range of 75 to 200, and wherein each polyester yarn have filaments ranging from 7-200, and wherein the total cover factor of the fabric is within a predefined range of 10 to 38, and wherein the warp cover factor is within a predefined range of 8-19, and wherein the weft cover factor is within a predefined range of 10-19.

19. The method of claim 18, further comprising:

dying either of the warp yarns or weft yarns after the fabric is weaved in order to obtain chambray effect or a special design effect in the fabric, or either of the weft yarns or the warp yarns with different shades after the fabric is weaved to give a unique texture look.

20. The method of claim 18, wherein the woven textile fabric has:

a warp to fill ratio within a predefined range of 3:1 and 1:1.3;

a total thread count of within a predefined range of 100 to 250 per inch;

a weight within a predefined range of 80 to 160 grams per square meter;

a width within a predefined range of 40 inches to 140 inches;

a warp tear strength of the woven fabric is within a predefined range of 2 lbf to 10 lbf;

a weft tear strength of woven fabric may be within a predefined range of 1 lbf to 10 lbf;

a tensile strength of the warp is within a predefined range of 20 lbf to 120 lbf; and a tensile strength of the weft may is within a predefined range of 10 lbf to 60 lbf.

* * * * *